US005668874A

United States Patent [19]

Kristol et al.

[11] Patent Number: 5,668,874

[45] Date of Patent: Sep. 16, 1997

[54] IDENTIFICATION CARD VERIFICATION SYSTEM AND METHOD

[75] Inventors: David M. Kristol, Summit; Lawrence P. O'Gorman, Madison, both of N.J.

[73] Assignee: Lucent Technologies Inc., Murray Hill, N.J.

[21] Appl. No.: 396,307

[22] Filed: Feb. 28, 1995

[51] Int. Cl.[6] ..... H04K 1/00

[52] U.S. Cl. ..... 380/23; 380/25; 380/49; 380/51

[58] Field of Search ..... 380/23, 25, 49, 380/51, 55

[56] References Cited

U.S. PATENT DOCUMENTS

| | | | |
|---|---|---|---|
| 4,737,859 | 4/1988 | Van Daele | 358/296 |
| 4,991,205 | 2/1991 | Lemison | 380/5 |
| 4,993,068 | 2/1991 | Piosenka et al. | 380/23 |
| 4,999,065 | 3/1991 | Wilfert | 156/64 |
| 5,157,424 | 10/1992 | Craven | 346/160 |
| 5,259,025 | 11/1993 | Monroe et al. | 380/23 |
| 5,321,751 | 6/1994 | Ray et al. | 380/23 |
| 5,321,765 | 6/1994 | Costello | 382/4 |
| 5,351,302 | 9/1994 | Leighton et al. | 380/30 |
| 5,436,970 | 7/1995 | Ray et al. | 380/23 |

*Primary Examiner*—David C. Cain

[57] ABSTRACT

A self-verifying identification card having an image area which may contain a portrait, a finger print, a retinal image, or all of these together with an image signature which is derived from scanned intensity measurements taken from the image area. In the verification process, the image is scanned and aligned with respect to reference points corresponding to the original printing process which created the card, and intensity values, their averages, or any other function are compared to information provided by the image signature. Mathematical transformations, such as a one-way hash, an encryption, a compression algorithm, or a truth table may be used to encode the image signature. Alignment markers aid in scanning the image and the image signature. The use of average values aids in reducing noise and the use of comparison functions makes the process less sensitive to variations among scanners. The verification may be done at the point of a transaction, for a standalone system, or may be referred to a centralized data base in a networked system for further inquiry. In a networked system the image signature may be stored in the database.

58 Claims, 4 Drawing Sheets

100
30
ALPHANUMERIC
INFORMATION
abcdefghijklmnopqrstuvwxyzkkk 100
30
ALPHANUMERIC
INFORMATION
42
41
40
40
abcdefghijklmnopqrstuvwxyzkkk

IDENTIFICATION CARD VERIFICATION SYSTEM AND METHOD

BACKGROUND OF THE INVENTION

1. Cross Reference to Related Application

This application is related to another U.S. patent application, Ser. No.08/395,547 entitled "Self-Verifying Identification Card" (Kristol 2–12), with this application being concurrently filed with the present application, having the same inventors, and being incorporated herein by reference.

2. Field of the Invention

This invention relates to an identification card verification system, and in particular to one in which the identification card carries an image which is scanned for optical values which are compared to an image signature to verify that there have been no alterations to the card. The verification can be made at the point of transaction or by reference to a central data base.

3. Description of Related Art

The use of identification cards is proliferating in commercial transactions such as check cashing and credit cards, security applications to gain access to premises, licenses of various kinds, and passports, which may be considered one of the first uses of an identification card.

In structure, the cards usually contain a photograph of a person. Recently additional features are sometimes added such as a signature, fingerprint, or even the image of the person's retina. Each of these is a characteristic which is unique to each human being, and their addition reflects attempts to mitigate the possibility of forged identification cards. As greater reliance has been placed upon these cards, their value to unauthorized users and to unauthorized purveyors of false identification cards has also increased significantly. Counterfeiters routinely obtain or make passport and driver license blanks and affix a photograph for a small fee.

With the increased number and variety of identification cards, automated methods of their manufacture have been developed. U.S. Pat. No. 4,999,065 to Wilfert describes a method of transferring a video image of a person, signature, or fingerprint into digital form, adding data from a keyboard, and laser printing the composite.

U.S. Pat. No. 5,157,424 to Craven et al. teaches a method to superimpose a signature over a portrait wherein the signature is scaled in size and printed in a tone which is reverse to that of the portrait. So the signature would appear white if applied over dark hair. This is an example of a card which is harder to counterfeit.

U.S. Pat. No. 4,737,859 to VanDaele shows a bi-level recording device which produces a composite half-tone record in which images of different subjects remain visually distinguishable. Digital information from the two images is fed into an EXOR gate which drives a print engine to produce a composite of a portrait and line work. This is quite similar to the previous patent.

U.S. Pat. No. 5,321,751 to Ray et al. describes a method and apparatus for credit card verification wherein a picture accompanies an application for the card. The picture information is converted into a digital image which is stored centrally or at the point of a transaction. The digital image is also stored in a medium like a magnetic stripe used by many cards or into an electronic storage system such as in "smart cards". At the point of sale the digital image of the presenter is converted to a video monitor display. The card administration agency also receives a verification request together with an identification code provided by the presenter which selects an algorithm to translate the stored digital information into a video display. In this invention the photograph is not on the card.

Accordingly, there is a need for an identification card verification system which accepts data from a broad variety of scanners. The system and the verification process also need to be robust, in that the verification should be insensitive to noise caused by imperfections or dust on the card. In particular, they should be resistant to any attempt at tampering or counterfeiting.

SUMMARY OF THE INVENTION

The present invention relates to a self-verifying identification card system and its operation, and in particular to a system which carries information which is used to verify that there have been no alterations to the card. The verification can be made at the point of a transaction or by reference to a central data base.

The identification card contains an image area which typically contains the photographic portrait of a human being. However, other characteristics which are unique to that person may also be used, such as: a fingerprint, a signature, or an image of the person's retina, or any combination of these. The card also contains an image signature, which is prepared from optical values sampled from or about selected reference points within the image area. The values may be taken from gray scale, color, or they may be taken from a amthematical transformation, such as, a Fourier Transform. The card thus contains information on itself which indicates whether attempts have been made to substitute the image in the image area. For noise free and robust operation several optical values are determined in a cluster around each reference point and averaged. To accommodate the variations in commercial scanning devices which read the optical value, a functional relationship of the average optical value around a reference point to other optical values at reference points near the former one is used to create the image signature which is provided on the card.

A registration feature may be designated on the identification card, described above, which provides information regarding the orientation of the card in the scanning device. The placement of the registration feature, or other indicia on the card, can also provide information regarding the selection of a mathematical translation function which may be used to translate the optical value information to an encoded format of the information on the card. The mathematical translation function may include: an encryption scheme, a one-way hash, a compression algorithm, or a truth table, used separately or in combination. These functions are well known in the art of computer science.

In one embodiment of the invention, a self-verifying identification card system employs a card with an image area and an image signature area, both being readable by means for scanning the information on the card, and a computer which is linked to the scanner which compares the optical value information on the presented card to the information recorded in the image signature and indicates whether these data match. The image signature is mathematically translated so that a counterfeiter cannot code a forged photograph since he does not have the secret key needed for translation. The computer may also be linked to a data base which exchanges information with the computer.

In another embodiment of the invention, a network links scanners and a computer to a data base which contains image signatures. Optical values from the identification card are read by a scanner, transmitted to the computer which calculates and image signature, and compares it to the image signature in the data base associated with the card. The image signature may be mathematically transformed, for security, as before.

In yet another embodiment, a self-verifying identification card system is described wherein the image and a first image signature are scanned from the identification card. A computer is adapted to compare the first image signature to a second one which it computes from optical values read from the card. The computer is also linked to a data base which contains a third image signature. A comparison of these image signatures is made and the results are transmitted to indicating means. The image signatures may be in a mathematically transformed format, and the selection of the format may be determined from indicia on the card.

In still another embodiment of the invention, a method is described which employs the identification card defined above to verify the validity of the card. Digital information, including optical values, reference features, and a first image signature is read by a scanner. A second image signature is computed from the optical values and compared to the first image signature. A successful match is indicated. Alphanumeric or bar code information may also be read from the card and compared to the image signature.

In a further embodiment, an image signature is computed from optical values read from the image area of the card and a comparison is made to an image signature stored in a data base. Alphanumeric or bar code information may also be read from the card and compared to the image signature.

In yet another embodiment, optical values and a first image signature are read from the identification card, a second image signature is computed from the optical values, a comparison is made of these image signatures, and the presence of a match is indicated. A third image signature associated with the card is retrieved from a data base, and the first and third image signatures are compared, and a match is indicated. Alphanumeric or bar code information may also be read from the card and compared to the image signature. Attempts made to verify the card and transactions made after verification, may also be recorded.

These and other features and advantages of the invention will be better understood with consideration of the following detailed description of the preferred embodiments taken in conjunction with the accompanying drawings.

BRIEF DESCRIPTION OF THE DRAWINGS

FIG. 1B shows a coordinate system for reference points within one area of the card;

FIG. 2 is a block diagram of components for a self-verifying identification card system;

The drawings are not to scale.

DETAILED DESCRIPTION OF THE PREFERRED EMBODIMENTS

Figure 1A:
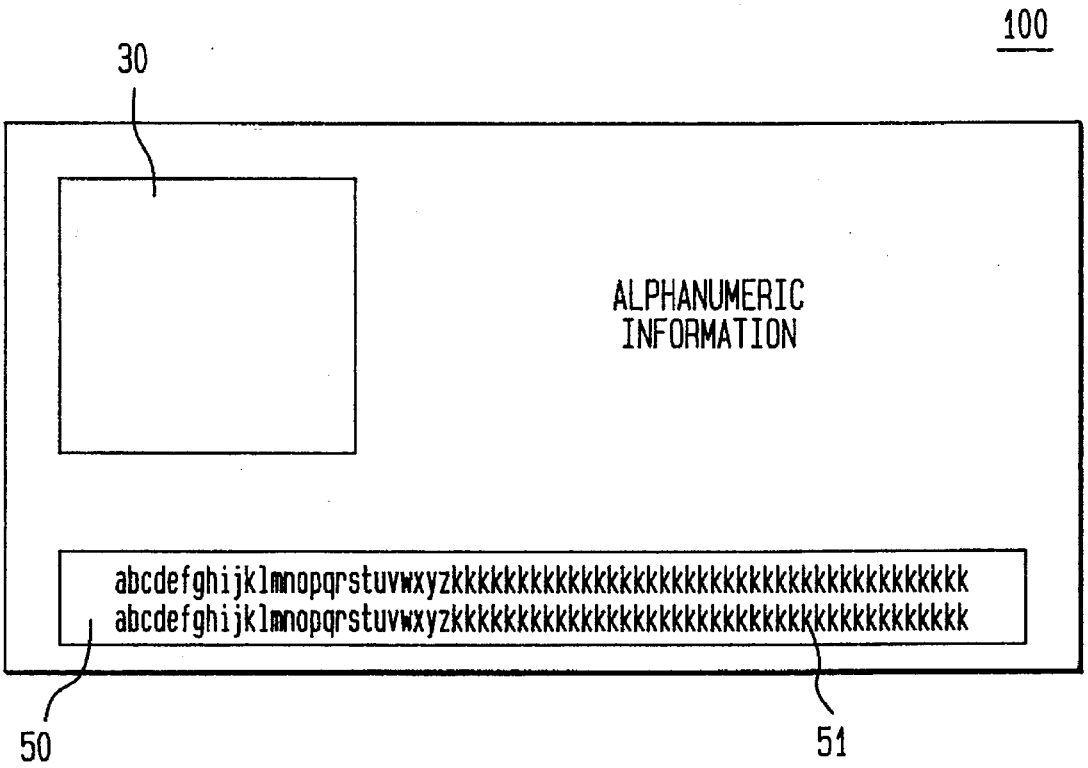
FIG. 1A, is a front view of a self-verifying identification card.
Figure 1C:
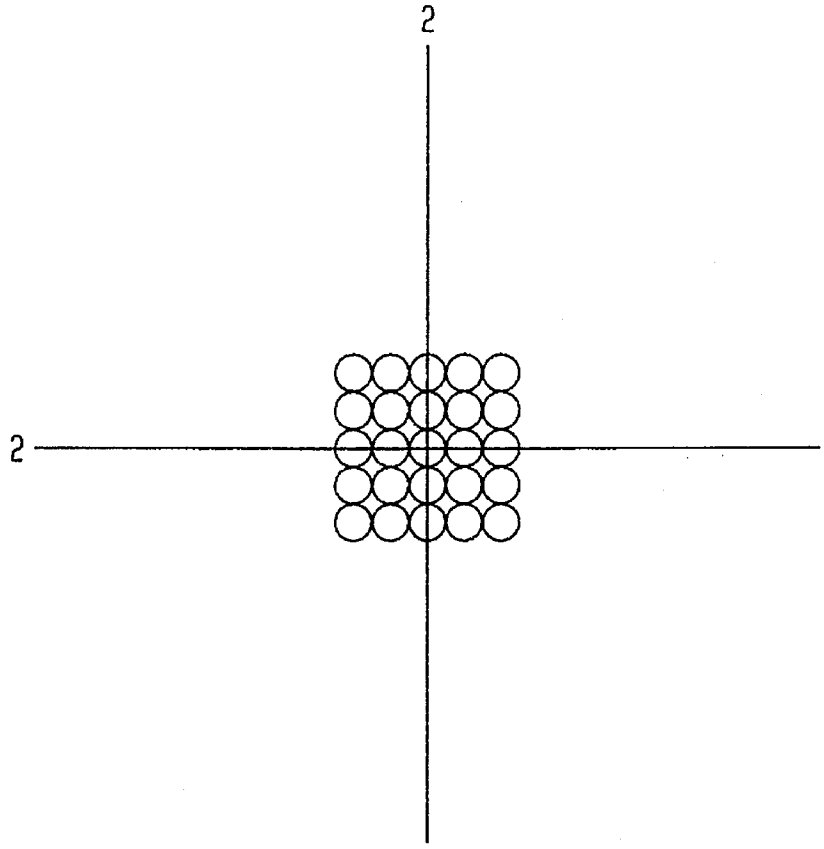
FIG. 1C shows a cluster of pixels which are sampled around a reference point.
Figure 1D:
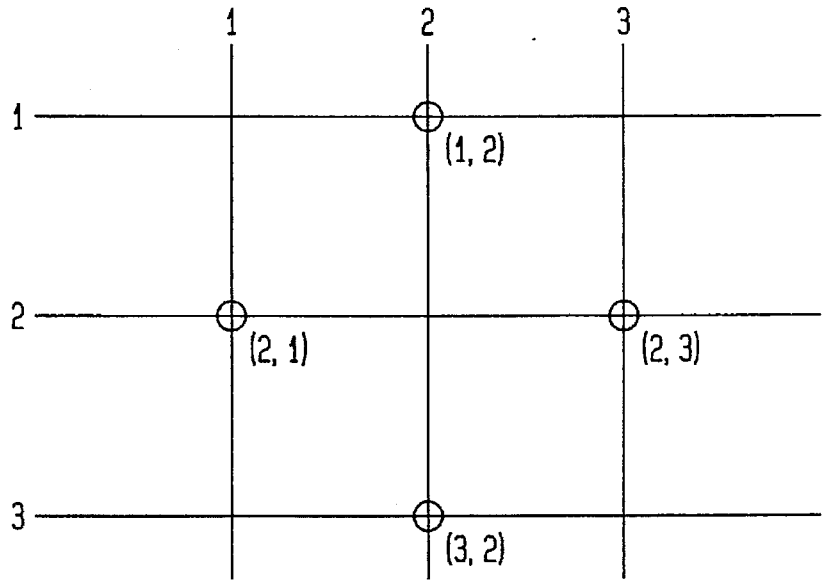
FIG. 1D shows nearest neighbor reference points surrounding a reference point.

Referring now to FIG. 1A, there is shown apparatus 100 which is an identification card having an image area 30 occupying a portion of the card. Also provided on the card is an area 50 containing an image signature 51. The remaining area of the card may be used for alphanumeric text which describes the issuer, type, and purpose of the card, together with any state seal or corporate logo. The image area typically contains a photographic portrait of a human being, but it could also contain a fingerprint, a signature, the image of the human's retina, or any combination of these. The image area is mathematically divided into a matrix of reference points which are more clearly shown in FIG. 1B. The matrix is constructed with a series of parallel horizontal and vertical lines labeled 1, 2, etc. in each direction. The intersection of the first horizontal and first vertical line determining reference point (1,1), and so on. To prepare the card, an image of a portrait, signature, fingerprint, or retinal image which is to be printed within the image area is scanned by devices which are well known in the art such as a Hewlet-Packard Scanjet or Logitech Scanner. These devices can read both the optical values in the image area and the characters or bar code in the image signature. A typical scanning resolution is 300 dots per inch (dpi) which is also typical of laser printer output. Each of the 300 dots being defined as a pixel. The optical value of whatever image is scanned is taken at each reference point, and commercial scanners provide gray scale or color values ranging from 0 to 250 in arbitrary units. To provide a more robust system which is less sensitive to noise which is created by dust or bubbles which can occur on the card or by noise in the scanning device, an array of optical values about each reference point may be taken and the values averaged to represent the optical value at the reference point. One such scheme is shown in FIG. 1C, where a 5×5 array is selected about reference point (2,2). Each of the dots being about 0.0033 inches in diameter for 300 dpi resolution. Reference point (2,2) may be separated from its nearest neighbors (1,2), (2,3), (3,2), and (2,1) by 0.1 inch or any other distance determined by the algorithm selecting the reference points. The nearest neighbors are indicated in FIG. 1D.

To accommodate the different gain characteristics of various printer models, experience has shown that a functional relationship describing the optical value at a reference point (or its average value as determined from an array such as shown in FIG. 1C) compared to other optical values in the image area, provides a value which is a more reliable and reproducible indicator of the optical value at the reference point. The functional relationship may be derived from any truth table which relates the optical value to others in the image area. It may also be the ratio of the value at a point to others in the image area. In a preferred embodiment, the optical value at a reference point is quantified into a three level function wherein optical values greater than, equal to, or less than surrounding optical values are ascribed values of "1", "0.5", or "0", respectively. The process is repeated for each reference point, and the series of values becomes the image signature which is imprinted on the card combined with any other information the card issuer wants. The information may further describe the cardholder and add items such as citizenship, corporate permission codes, health profiles, or financial details. This information may be in encrypted format anywhere on the card, but in a preferred embodiment it is placed within a specified area, such as area 50.

Figure 1E:
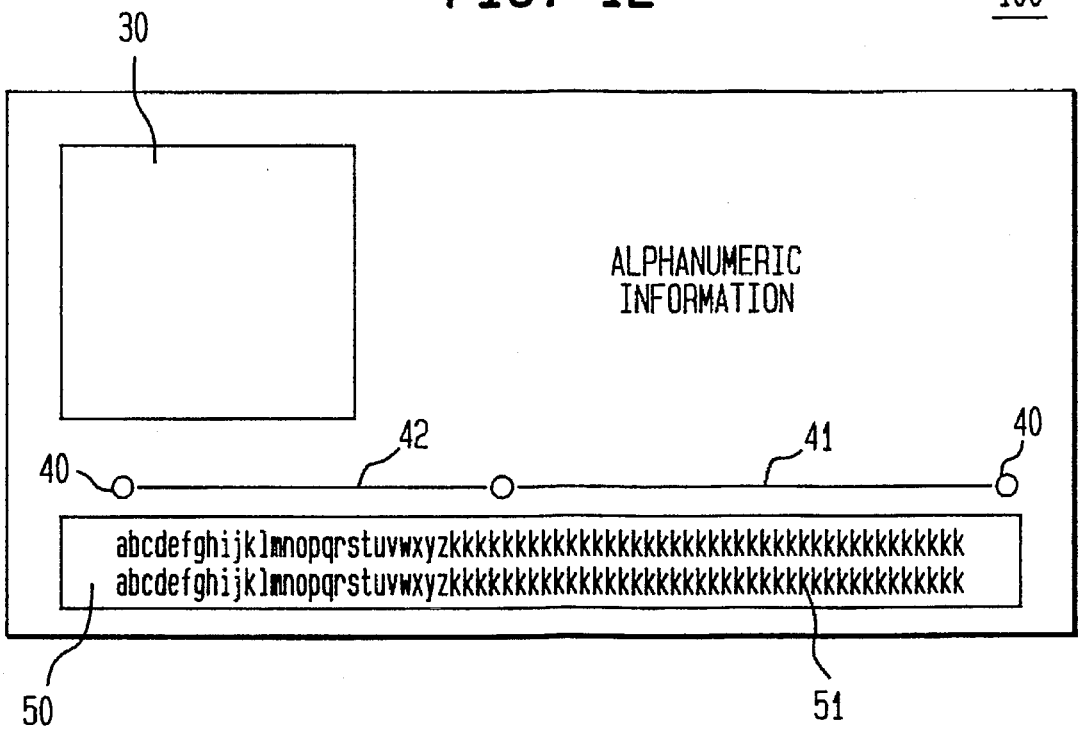
FIG. 1E shows another embodiment of the identification card.

In FIG. 1E, registration features 40 may be used to determine the orientation, location, and scale of the card as it is inserted into a commercial scanner. They are shown as round dots approximately 0.1 inches in diameter which are easily recognized by the algorithm searching the digital information from the scanner. Preferably the alignment features are placed away from any axis of symmetry so that the orientation of the card is unmistakable. Other indicia 41 and 42 may also be added to the card and their length may indicate a different encryption scheme for each card, to add another level of security. The perimeter of the image area may also serve as a registration feature to orient and scale the card, and any alphanumeric character on the card, such as a particular letter in a person's name may be used as an indicator of a particular encryption function.

The result is a card which is self-verifying because any tampering with the image in the image area cannot correspond to the image signature containing optical values of the original image. By using the average of optical values of a cluster of pixels around each reference point, noise caused by dust or imperfections in the card or the scanner is reduced to provide a robust and reliable verification. By using a functional relationship to describe the optical value at one reference point compared with others in the image area, the card becomes less sensitive to the characteristics of commercial scanners.

Referring now to FIG. 2, there is shown system 200 in accordance with another embodiment of the invention. Identification card 100, described above, is shown partially inserted into scanning means 210. Commercial scanners operate by raster scanning every pixel on the card with resolutions that are adjustable from 100 dpi to 600 dpi. A resolution of 200 dpi to 300 dpi is preferred in this application. Scanning means 210 could also be a scanner developed for this application wherein the whole card is not scanned at high resolution, but only areas around the reference points, the image signature, and the alignment features are scanned at high resolution under computer control. Preferential scanning, as described, would enhance throughput.

The optical values are communicated to computing means 220 which contains an algorithm or a set of algorithms which operate on the optical value at each reference point in the image area of the card, the average of a cluster of readings around the reference point, or the three-level function of the average optical value around the reference point compared to the same values of nearby neighbors. Computing means 220 compares whatever optical value is associated with each reference point to the image signature read from the identification card. If a match is determined, the card is verified and the computer sends a signal to indicating means 222, which may be a screen display, a simple light, or a tone. Similarly, a rejection signal is sent if no match is found.

Since the card is self-verifying, a standalone embodiment of the invention needs only an identification card with an image area and image signature, a scanner which reads the optical value of a gray scale or color image in at least one position in the image area and which reads the information in the image signature, computing means which compares these data, and indicating means which report the result.

Clearly, one or more standalone embodiments may be linked to a network having additional computing means, algorithms, and data bases which can perform the functions of verification, as above, or provide additional verification or more extensive functions relating to a transaction at the point of scanning. The distribution of these functions around the network may be optimized for increased speed, lower cost, or to match preexisting functions, which is common to the design of local and wide-area network installations.

The verification process may be recorded in data base 230, and where a match is found further exchanges between the data base and the computer are enabled. Computing means 220 may also have input means 224 which may enter details of a transaction such as a charge for a sale. Where the card is not verified, the existence of a defective card may also be recorded. Input means 224 may be an input from a cash register, bar code reader or similar device, or a typical keyboard.

Figure 3:
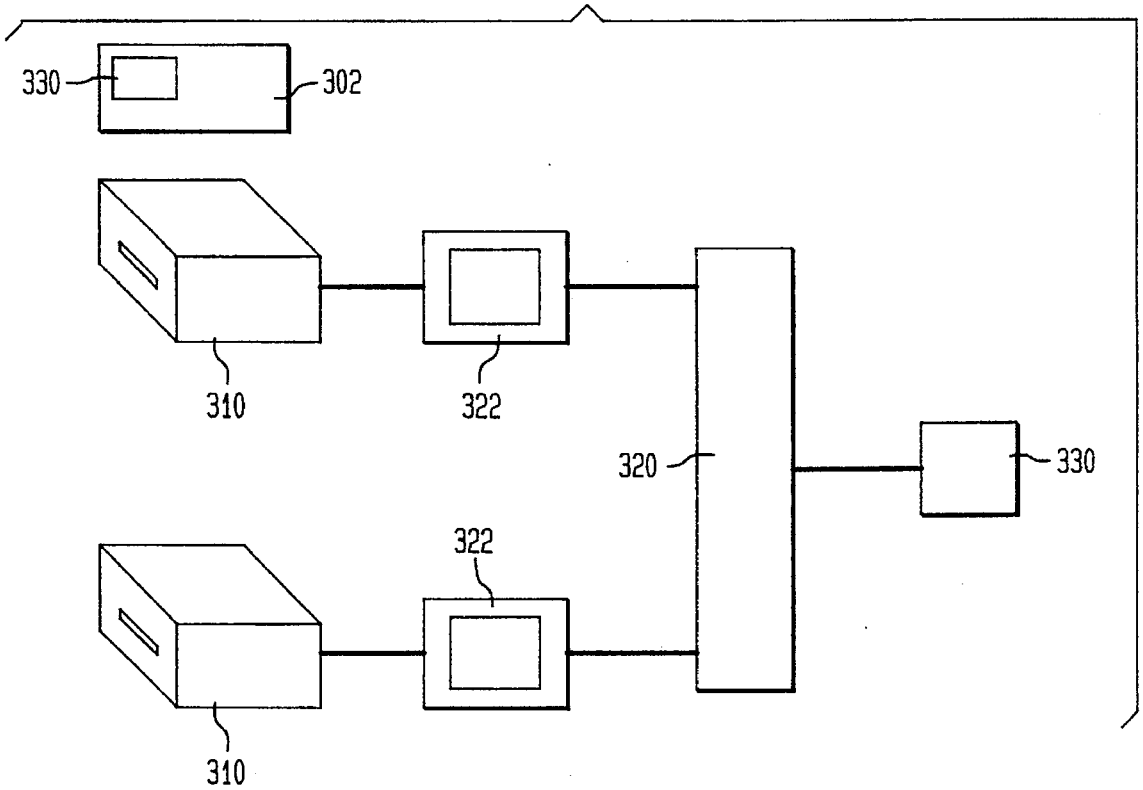
FIG. 3 shows a network for verifying an identification card.

Referring now to FIG. 3, there is shown a network to verify an identification card. Identification card 302 comprises an image area 330 displaying a characteristic which is unique to each human being, such as, a portrait, a signature, a fingerprint, or a retinal image, used singularly or in combination, together with alphanumeric or bar code information which is also imprinted upon the identification card by the issuer which further describes characteristics such as height, weight, age, account number, and the like.

A series of scanning means 310 are adapted to read optical values and alphanumeric or bar code information from the identification card. These scanners may be commercial scanners such as a Hewlet-Packard Scanjet, or a Logitech Scanner, or they may be specifically developed for this application as described in the discussion of FIG. 2. Each scanner is linked via a network to computing means 320 which contains an algorithm which operates upon the optical values from the image area read by the scanner and compares these data to an image signature, associated with the identification card, which is stored in data base 330. The steps to create the image signature have been discussed in the description of FIG. 2 and are incorporated here. The image signature may also be in a mathematically translated format, also described before, and indicia on the card may also indicate the kind of translation which links optical values to the image signature. Computing means 320 sends a signal through the network to indicating means 322 which provides the result of the comparison. Indicating means 322 may be a screen, a light, or a tone generator.

Figure 4:
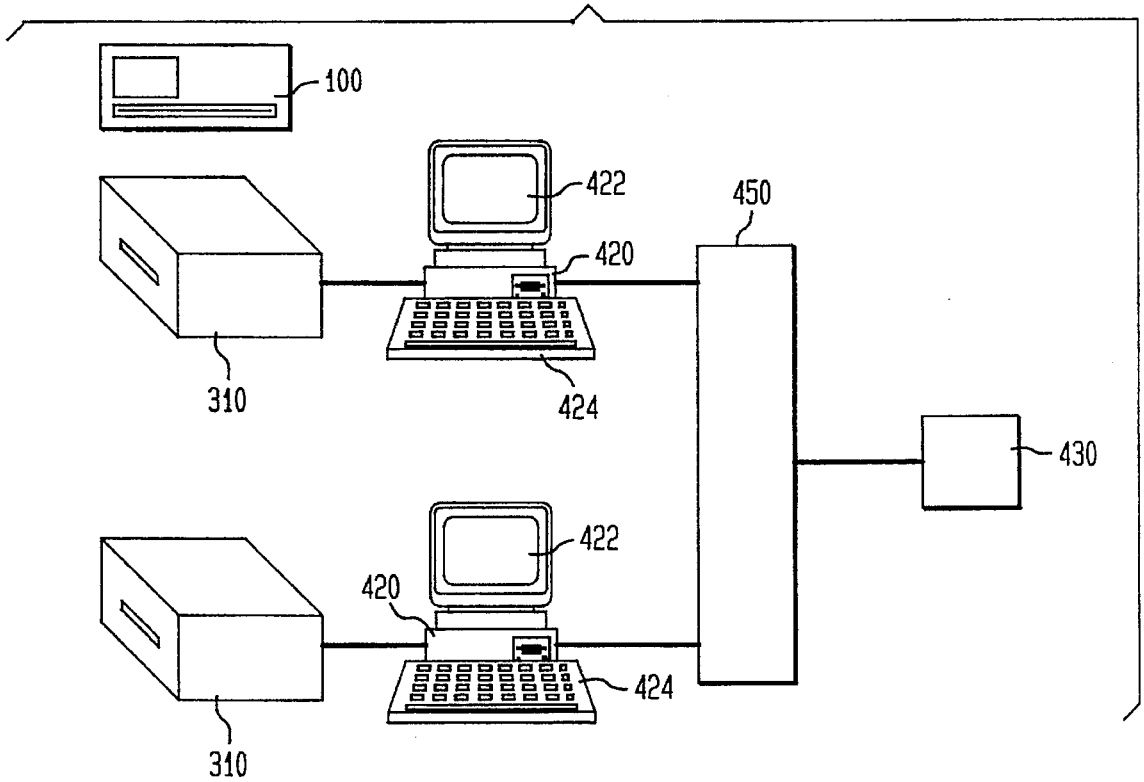
FIG. 4 shows a network utilizing a self-verifying identification card.

Referring now to FIG. 4, there is shown a self-verifying identification card system which is in accordance with another embodiment of the invention. In this case, the identification card 100 has been prepared according to the description provided for FIG. 1A to FIG. 1E. A first image signature is on the card. A series of scanning means 310 are as described for FIG. 3. The scanners are linked to computing means 420 comprising input means 424 and indicating means 422. The computing means may be hard-wired or programmable and the input means may be keys, a bar code reader, or a cash register. Data base 430 contains a second image signature which is associated with the identification card and which was prepared from optical values associated with at least one reference point in the image area. Network 450, which may also contain additional computing means, provides bi-directional access to the data base and all the computing means 420. The computing means contain an algorithm which compares optical values determined by the scanning means to the first image signature on the card and the second image signature stored in the data base. The image area of the card may contain a portrait, a signature, a fingerprint or a retinal image, used singly or in combination. The image signature may be derived from average optical values around a reference point, and a function which may be a three-level function, a ratio, or one derived from a truth table as described before. The image signature may also be in a mathematically translated format, such as, a one-way hash function, an encryption scheme, a compression algorithm, or a truth table, used separately or in combination. These functions are well known in computer science. The selection of the format may be determined by indicia on the card for an added level of security.

The invention also includes a method of verifying an identification card which comprises an image area and a first image signature which is derived from optical values from within the image area. In this embodiment, the card is scanned to obtain digital information which is entered into computing means, which computes the digital information regarding the optical values at selected reference points within the image area to get a second image signature which compared to digital information from the image signature. The discussion above regarding the preparation of the image signature and its mathematical translations is repeated here. Other steps in the verification process may include reading alphanumeric or bar code information from the identification card, comparing this to information within the image signature, and indicating whether these data match.

Another embodiment of the invention is a method of verifying an identification card comprising an image area having an image of a human characteristic, one or more reference points within the image area, and at least one registration feature which is adapted to determine the orientation and scale of the identification card, where the steps are: scanning the identification card to obtain digital information, computing a first image signature from an optical value associated with each reference point, comparing the first image signature to a second image signature which is stored in a data base, and indicating whether the first image signature matches the second image signature. Additional steps may include reading alphanumeric information from the identification card, comparing this information to information stored within the data base, and, indicating whether the alphanumeric information read from the card matches information from within the data base. The creation of the image signature and the functions which may mathematically transform it have been described and are incorporated here.

A further embodiment is a method of verifying an identification card comprising an image area having an image of a human characteristic, one or more reference points within the image area, at least one registration feature which is adapted to determine the orientation and scale of the identification card, and a first image signature derived from optical values associated with each reference point. The steps include: scanning the identification card to obtain digital information, computing a second image signature from the digital information associated with at least one optical value about at least one reference point, comparing the computed second image signature to the first image signature which was scanned from the identification card, indicating whether the first image signature matches the second image signature, retrieving a third image signature associated with the identification card from a data base, comparing the first image signature to the third image signature, and indicating whether the first image signature matches the third image signature. Additional steps may include reading alphanumeric information from the identification card, comparing this information to information stored within the data base, and, indicating whether the alphanumeric information read from the card matches information from within the data base. The creation of the image signature and the functions which may mathematically transform it have been described and are incorporated here.

Further steps may include recording information regarding attempts to verify the information card and recording transactions made after the identification card is verified.

The previously described embodiments of the invention provide advantages including methods and networks wherein an identification card is accepted by a broad variety of scanners and one which is compatible with a many picture based identification cards as they are renewed. The card and the verification process are insensitive to noise. The various functions which create the image signature and the mathematical transformations though which the image signature is recorded make the network and process resistant to tampering or counterfeiting.

Changes and modifications in the specifically described embodiments can be carried out without departing from the scope of the invention. In particular, the number and location of the reference points within the image area can be varied without departing from the spirit of the invention and the number of pixels used in determining an average optical value around each reference point can be varied. The placement of data storage and computing means around the network may be varied to optimize the parameters of the network.

We claim:

1. A self-verifying identification card system for use with an identification card having an image and an image signature, wherein said image signature is derived from optical values contained within said image at at least one reference point, said system comprising:

a scanner for scanning the identification card, wherein said scanner reads said optical values associated with said at least one reference point in said image and reads said image signature; and a processor coupled to said scanner for comparing said optical values associated with said at least one reference point in said image to optical values represented in said image signature.

2. The identification card system of claim 1 wherein said image shows a characteristic which is unique to each human being.

3. The self-verifying identification card system of claim 1 wherein an average of a group of optical values at points located near a reference point defines the optical value at that reference point which is used to derive the image signature.

4. The self-verifying identification card system of claim 3 wherein the image signature is derived from a function relating the optical value at a reference point to other optical values within the image.

5. The self-verifying identification card system of claim 3 wherein the image signature is in a mathematically transformed format upon the identification card.

6. The self-verifying identification card system of claim 4 wherein the function is a three-level function.

7. The self-verifying identification card system of claim 4 wherein the function is a ratio.

8. The self-verifying identification card system of claim 3 wherein the function is derived from a truth table.

9. The self-verifying identification card system of claim 5 wherein a mathematical transformation function is determined from indicia on the card.

10. The self-verifying identification card system of claim 1 further comprising means for indicating the result of the comparison of the image signature to optical values from the image.

11. The self-verifying identification card system of claim 1 further comprising a registration feature which is an edge of an image area that contains said image.

12. The self-verifying identification card system of claim 1 wherein the image signature also includes data selected by the issuer of the card.

13. The self-verifying identification card system of claim 1 further comprising a data base adapted to exchange information with one or more computing means.

14. An identification card verification system for use with an identification card having an image area containing a portrait of a human being, wherein said portrait contains at least one reference point with distinct optical values and said identification card includes at least one registration feature disposed thereon, wherein said at least one registration feature determines the orientation, location, and scale of the identification card, said identification card further including an image signature which contains information derived from optical values associated with each reference point, said system comprising;

one or more scanning means for scanning the identification card and detecting said optical values associated with said at least one reference point in the image area; and one or more computing means linked to the scanning means, said computing means being adapted to compare optical values associated with said at least one reference point and determined by the scanning means from the image area to optical values represented in said image signature.

15. The identification card verification system of claim 14 wherein the image area contains a fingerprint.

16. The identification card verification system of claim 14 wherein the image area contains a signature.

17. The identification card verification system of claim 14 wherein the image area contains a retinal image.

18. The identification card verification system of claim 14 wherein an average of a group of optical values at points located near a reference point defines the optical value at that reference point which is used to derive the image signature.

19. The identification card verification system of claim 14 wherein the image signature is derived from a function relating the optical value at a reference point to other optical values within the image area.

20. The identification card verification system of claim 19 wherein the function is a three-level function.

21. The identification card verification system of claim 19 wherein the function is a ratio.

22. The identification card verification system of claim 19 wherein the function is derived from a truth table.

23. The identification card verification system of claim 18 wherein the image signature is in a mathematically translated format.

24. The identification card verification system of claim 23 wherein the mathematically translated format is determined from indicia on the card.

25. A self-verifying identification card system for use with an identification card having an image area, a portrait of a human being disposed in said image area, wherein said portrait contains at least one reference point having optical values, at least one registration feature disposed on said identification card and a first image signature disposed on said identification card which contains information derived from said optical values associated with each reference point, said system comprising:

one or more scanning means for scanning the identification card and detecting said optical values associated with said at least one reference point in the image area and to read the first image signature;

a data base containing a second image signature having information derived from optical values associated with at least one reference point in the image area, wherein said data base is adapted to exchange information with one or more computing means;

one or more computing means containing an algorithm and linked to the scanning means, said computing means being adapted to compare said optical values determined by the scanning means from the image area on the card to information from the first image signature and the second image signature; and means for indicating the result of the comparisons.

26. The self-verifying identification card system of claim 25 wherein the image area contains a fingerprint.

27. The self-verifying identification card system of claim 25 wherein the image area contains a signature.

28. The self-verifying identification card system of claim 25 wherein the image area contains a retinal image.

29. The self-verifying identification card system of claim 25 wherein an average of a group of optical values at points located near a reference point defines the optical value at that reference point which is used to derive the image signature.

30. The self-verifying identification card system of claim 25 wherein the image signature is derived from a function relating the optical value at a reference point to other optical values within the image area.

31. The self-verifying identification card system of claim 30 wherein the function is a three-level function.

32. The self-verifying identification card system of claim 30 wherein the function is a ratio.

33. The self-verifying identification card system of claim 30 wherein the function is derived from a truth table.

34. The self-verifying identification card system of claim 29 wherein the image signature is in a mathematically translated format.

35. The self-verifying identification card system of claim 34 wherein the mathematically translated format is determined from indicia on the card.

36. A method of verifying an identification card that has an image area containing an image of a human characteristic, at least one reference point within the image area, at least one registration feature and a first image signature which is derived from optical values associated with said at least one reference point, said method comprising the steps of:

scanning the identification card for obtaining digital information relating to said image area and said first image signature;

computing a second image signature from the digital information associated with at least one optical value from said at least one reference point;

comparing the computed second image signature to the first image signature scanned from the identification card; and indicating whether the first image signature matches the second image signature.

37. The method of claim 36 wherein the image signature is derived from an average of a group of optical values around a reference point.

38. The method of claim 36 wherein the image signature is derived from a function relating the optical value at a reference point to other optical values within the image area.

39. The method of claim 38 wherein the function is a three-level function.

40. The method of claim 38 wherein the function is a ratio.

41. The method of claim 38 wherein the function is derived from a truth table.

42. The method of claim 36 further comprising the steps of:

reading alphanumeric information from the identification card;

comparing said information to information within the image signature; and indicating whether the alphanumeric information read from the card matches information from within the image signature.

43. A method of verifying an identification card that includes an image area having an image of a human characteristic, at least one reference point within the image area, and at least one registration feature indicating the orientation, location and scale of the identification card, said method comprising the steps of:

scanning the identification card for obtaining digital information;

computing a first image signature from an optical value associated with said at least one reference point;

comparing the first image signature to a second image signature which is stored in a data base; and indicating whether the first image signature matches the second image signature.

44. The method of claim 43 further comprising the steps of:

reading alphanumeric information from the identification card;

comparing said information to information stored within the data base; and indicating whether the alphanumeric information read from the card matches information from within the data base.

45. The method of claim 43 wherein an image signature is derived from an average of a group of optical values around a reference point.

46. The method of claim 43 wherein the image signature is derived from a function relating the optical value at a reference point to other optical values within the image area.

47. The method of claim 46 wherein the function is a three-level function.

48. The method of claim 46 wherein the function is a ratio.

49. A method of verifying an identification card that includes an image area having an image of a human characteristic, at least one reference point within the image area, at least one registration feature which indicates orientation, location and scale of the identification card, and a first image signature derived from optical values associated with said at least one reference point, said method comprising the steps of:

scanning the identification card for obtaining digital information;

computing a second image signature from at least one optical value associated with said at least one reference point;

comparing the computed second image signature to the first image signature scanned from the identification card;

indicating whether the first image signature matches the second image signature;

retrieving a third image signature associated with the identification card from a data base;

comparing the first image signature to the third image signature; and indicating whether the first image signature matches the third image signature.

50. The method of claim 49 wherein each said image signature is derived from the average of a group of optical values around a reference point.

51. The method of claim 49 wherein the image signature is derived from a function relating the optical value at a reference point to other optical values within the image area.

52. The method of claim 51 wherein the function is a three-level function.

53. The method of claim 51 wherein the function is a ratio.

54. The method of claim 51 wherein the function is derived from a truth table.

55. The method of claim 49 further comprising the steps of:

reading alphanumeric information from the identification card;

comparing said information to information within the first image signature;

comparing said information to a third image signature stored in a data base; and indicating whether the alphanumeric information read from the card matches information from within the first image signature and within the third image signature.

56. The method of claim 49 further comprising recording information regarding attempts to verify the information card.

57. The method of claim 49 further comprising recording transactions made after the identification card is verified.

58. The self-verifying identification card system of claim 15, further including, a data base adapted to store the image signature and exchange information with one or more computing means; and means for indicating the result of the comparison.

* * * * *